US007311879B2

(12) United States Patent
Hodson

(10) Patent No.: US 7,311,879 B2
(45) Date of Patent: Dec. 25, 2007

(54) SYRINGE PUMP

(76) Inventor: Steve J. Hodson, 3564 Dunlop Ct., Mason, OH (US) 45040

( * ) Notice: Subject to any disclaimer, the term of this patent is extended or adjusted under 35 U.S.C. 154(b) by 820 days.

(21) Appl. No.: 10/641,317

(22) Filed: Aug. 14, 2003

(65) Prior Publication Data

US 2005/0036919 A1 Feb. 17, 2005

(51) Int. Cl.
*B01L 3/02* (2006.01)

(52) U.S. Cl. ..... 422/100; 422/63; 422/64; 422/65; 422/99; 422/101; 422/102; 222/23; 222/52; 222/135; 222/173; 436/180

(58) Field of Classification Search ..... 422/99–100, 422/63–63, 99–102; 222/135, 23, 52, 173; 436/180

See application file for complete search history.

(56) References Cited

U.S. PATENT DOCUMENTS

| | | | | |
|---|---|---|---|---|
| 4,137,913 | A | 2/1979 | Georgi | |
| 4,424,720 | A | 1/1984 | Bucchianeri | |
| 4,529,401 | A | 7/1985 | Leslie et al. | |
| 4,598,840 | A * | 7/1986 | Burg | 222/135 |
| 4,767,406 | A | 8/1988 | Wadham et al. | |
| 4,978,335 | A | 12/1990 | Arthur, III | |
| 5,037,396 | A | 8/1991 | Streeter | |
| 5,139,484 | A | 8/1992 | Hazon et al. | |
| 5,176,502 | A | 1/1993 | Sanderson et al. | |
| 5,232,449 | A | 8/1993 | Stern et al. | |
| 5,254,096 | A | 10/1993 | Rondelet et al. | |
| 5,269,762 | A | 12/1993 | Armbruster et al. | |
| 5,295,967 | A | 3/1994 | Rondelet et al. | |
| 5,322,511 | A | 6/1994 | Armbruster et al. | |
| 5,536,249 | A | 7/1996 | Castellano et al. | |
| 5,545,140 | A | 8/1996 | Conero et al. | |
| 5,611,784 | A | 3/1997 | Barresi et al. | |
| 5,672,155 | A | 9/1997 | Riley et al. | |
| 5,993,423 | A | 11/1999 | Choi | |
| 6,019,745 | A | 2/2000 | Gray | |
| 6,551,277 | B1 | 4/2003 | Ford | |

OTHER PUBLICATIONS

Advertisement, Magazine, by J-Kem Scientific, Inc., May 5, 2003, p. 61, Chemical & Engineering News Magazine, vol. 81, No. 18, United States.

* cited by examiner

*Primary Examiner*—Jill Warden
*Assistant Examiner*—Jyoti Nagpaul
(74) *Attorney, Agent, or Firm*—Ronald J. Richter; Hasse & Nesbitt LLC

(57) ABSTRACT

The invention is directed to a syringe pump for the controlled addition of reagents to a chemical reaction. The pump has a reduced size for use as a cordless, hand-held laboratory device, and includes a driving mechanism for moving the plunger of a syringe along the syringe barrel, a means for sensing a physical property of the reaction mixture, and a logic control circuit. The driving mechanism includes a motor, a drive shaft, a drive block, and a sliding barrel clamp. The logic control circuit is programmable and controls the syringe pump based on predetermined parameters. The syringe pump adapts the delivery rate of reagent according to changes in physical properties of the reaction mixture such as pH and/or temperature, thus providing a high degree of automated control over a chemical reaction.

7 Claims, 6 Drawing Sheets

SYRINGE PUMP

BACKGROUND OF THE INVENTION

I. Field of the Invention

The present invention relates generally to syringe pumps, and in particular to a programmable, battery-charged syringe pump for the controlled addition of reagents to a chemical reaction, which can adapt the rate of addition of reagent according to changes in physical properties of the reaction mixture such as reaction temperature and pH content.

II. Description of the Prior Art

In small-scale chemical reactions (e.g. laboratory research), the controlled addition of reagents to a chemical reaction is often accomplished by use of disposable plastic syringes. A scientist may choose to fill a disposable syringe with the desired reagent and then manually control the rate of addition of the reagent into a reaction mixture. While this manual method may afford good control of the addition rate of the reagent, it requires "hands-on" syringe operation to inject small portions of the reagent over time, resulting in poor use of valuable labor time. Addition funnels have long been used to control addition of chemical reagent to a reaction mixture, but they give unreliable control, require "hands-on" adjustment during the addition phase, and offer no direct control of the reaction mixture.

In medium-scale chemical reactions utilizing between 1-20 liters of reaction mixture (e.g. process development), metering valves and analytical balances are sometimes used in conjunction with either pressure or a vacuum to transfer large volumes of liquid reagents into the reaction mixture. This method requires significant monitoring by the chemist and gives poor control of the addition rate. Liquid transfer pumps (i.e. piston pumps) are sometimes used in this process, but these piston pumps are generally unreliable, being prone to leakage and seizure during operation.

It is known that the rate of addition of chemical reagent to a reaction mixture can be adequately controlled by use of programmable syringe pumps. Most available prior art programmable syringe pump devices are large (requiring up to a square ft. of bench top space), expensive, and require significant set-up time. In addition, their large size usually requires them to have a transfer line connecting the syringe to the reaction mixture, creating the problem of reagent material being trapped in the transfer lines.

The company J-Kem® sells a multiple component system consisting of three separate devices that will control a syringe based on temperature or pH, however this system is bulky, requires electrical cords, and is not portable. No prior art syringe pump is available as a single, hand-held device capable of monitoring physical properties of the reaction mixture such as temperature and/or ion content thereof, and then altering the programmed addition rate of the reagent to the reaction mixture according to these physical properties.

Therefore, while currently available prior art syringe pumps may fulfill their respective, particular objectives, a further need exists for a single automated device that is adapted not only to control the automated dispensing of reagent from a syringe but also to sense physical properties of the reaction mixture such as temperature and/or ion content as the reagent is being added. Also, a need exists for a syringe pump that is able to automatically adjust the addition rate of the reagent as is necessary according to changes in the reaction mixture over time. Further, a need exists to incorporate a syringe pump with temperature and ion sensing capabilities into a single device small enough to easily fit under a reaction hood in a laboratory.

SUMMARY OF THE INVENTION

Accordingly, one objective of the present invention is to provide a device that delivers reagents to a chemical reaction mixture in such a way as to substantially decrease the amount of human monitoring needed during the addition rate. Another objective is to control the addition rate of reagent over time according to how a particular reaction is proceeding. Yet another objective is to provide a small, hand-held, automated syringe pump that can be easily programmed to dispense reagent from a syringe. A further objective is to provide a device capable of sensing physical properties of a chemical reaction and control that reaction's progress automatically.

To this end, the syringe pump of the present invention provides automated control of the addition of reagent into a reaction mixture. In addition, the invention enables automated changes in the dispensing rate of reagent according to changes in temperature and ion content (i.e. hydrogen, chloride, chlorate, perchlorate, fluoride, sodium, calcium, and iron ions, as well as the oxygen content in the water) as the reaction progresses. Further, the device allows the user to program the automated delivery of either very small or very large amounts of reagent over time, and permits the optional addition of a check-valve assembly to the syringe, so that multiple syringe loads may be delivered to the reaction mixture over time.

Briefly stated, the syringe pump of the present invention includes a means for securing a syringe of the kind having a plunger movable along a barrel, a means for moving the plunger along the barrel, a means for sensing the physical properties of the reaction mixture, and a logic control circuit, or microcontroller, for receiving the information sensed about the reaction mixture. The means for moving the plunger is preferably a syringe driving mechanism which includes a motor, at least one drive shaft, a drive block, and a manual control switch. The logic control circuit controls the syringe driving mechanism over time based on predetermined parameters, such that the plunger of the syringe is moved along the barrel of the syringe to expel chemical reagent which has been loaded into the syringe barrel. The movement of the syringe driving mechanism is alterable by the logic control circuit according to the physical properties of the reaction mixture.

The pump preferably has an external housing that includes a head, a body, and a base, with the motor and power for the pump located in the head, the drive shaft and drive block located in the body, and the barrel clamp housed in the base. The drive shaft is connected at one end to the motor, and the other end of the drive shaft is free to rotate in a journal bearing located on the external housing for the base. In accordance with one aspect of the invention, the device is relatively small, hand-held, inexpensive, and requires significantly less set-up time than other prior art pumps.

The pump may be set up such that no transfer lines between the syringe and the reaction mixture are present, which permits the performance of chemical reactions in an inert atmosphere. It also provides highly accurate delivery of reagent into the reaction mixture and requires no monitoring during the addition phase. In addition, the apparatus is small enough to be used under a laboratory reaction hood and without user interaction, thus allowing the reaction to proceed in a safe environment while leaving the users hands free to perform other activities.

In accordance with another aspect of the invention, the device incorporates input jacks for receiving plug-in probes.

The probes can have a their sensing end placed into the reaction mixture, and the plug-in end is plugged into the jacks located on the pump, thereby allowing the logic control circuit to measure physical properties of the mixture as the reaction proceeds. The information received from the reaction mixture allows the logic control circuit to change the dispensing rate of reagent during the addition phase to adapt to changes in the reaction milieu, thus providing a high degree of reaction mixture control.

The syringe pump of the present invention can employ commonly available disposable plastic syringes to transfer and deliver a single portion of liquid of about 1 ml to about 50 ml volume, and over any desired time from about 1 to about 99 minutes. Thus the reagent is dispensed at a rate of ml/min, ml/hour, cm/sec, etc. The disposable plastic syringe can be easily mounted on the pump, and, once loaded into the syringe pump, can also be connected to a check valve for delivering multiple syringe volumes (i.e. in the range of 1 liter of total volume) to the reaction mixture over time.

The syringe pump includes a manual control switch for manual actuation of the plunger. This manual control switch is either directly or indirectly connected to the stepping motor, allowing the user to bypass the electronic control of the logic control circuit over the motor and manually operate the syringe. The manual control switch is useful both for loading of reagent into the syringe prior to use, and for manual control of reagent addition to the reaction mixture during the course of the reaction.

In a preferred embodiment, the logic control circuit, or microcontroller, receives initial operating commands such as the rate of dispensing of reagent. A keypad having control buttons is located on the head of the pump for the user to enter operating commands to the microcontroller. An LCD display system, driven by the microcontroller, is preferably placed on the housing head of the syringe pump to display a predetermined set of parameters relating to the operating conditions of the syringe pump. In a preferred embodiment, the syringe pump is powered by a rechargeable battery. This battery can be any rechargeable battery system, such as nickel-cadmium, nickel metalhydride, etc. Alternatively, the pump can be attached to an AC power outlet via an electrical cord and AC adapter.

The syringe pump described herein is extremely advantageous and is ideally suited for use in the chemical and allied industries, including pharmaceutical, biotechnology, microelectric, materials science and polymer research, development and manufacture. It is suitable for handling single syringe volumes of air- and moisture-sensitive chemicals and for use as a transfer pump for larger liquid volumes. In accordance with one aspect of the invention, the addition of reagent from the syringe can be very accurately controlled in response to changes within the reaction mixture over time. A further understanding of the nature and advantages of the present invention will be more fully appreciated with respect to the following drawings and detailed description.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE INVENTION

For purposes of this invention, the term "pH" is defined as follows: a measure of acidity and alkalinity of a solution that is a number on a scale on which a value of 7 represents neutrality and lower numbers indicate increasing acidity and higher numbers increasing alkalinity and on which each unit of change represents a tenfold change in acidity or alkalinity and that is the negative logarithm of the effective hydrogen-ion concentration or hydrogen-ion activity in gram equivalents per liter of the solution.

Figure 1:
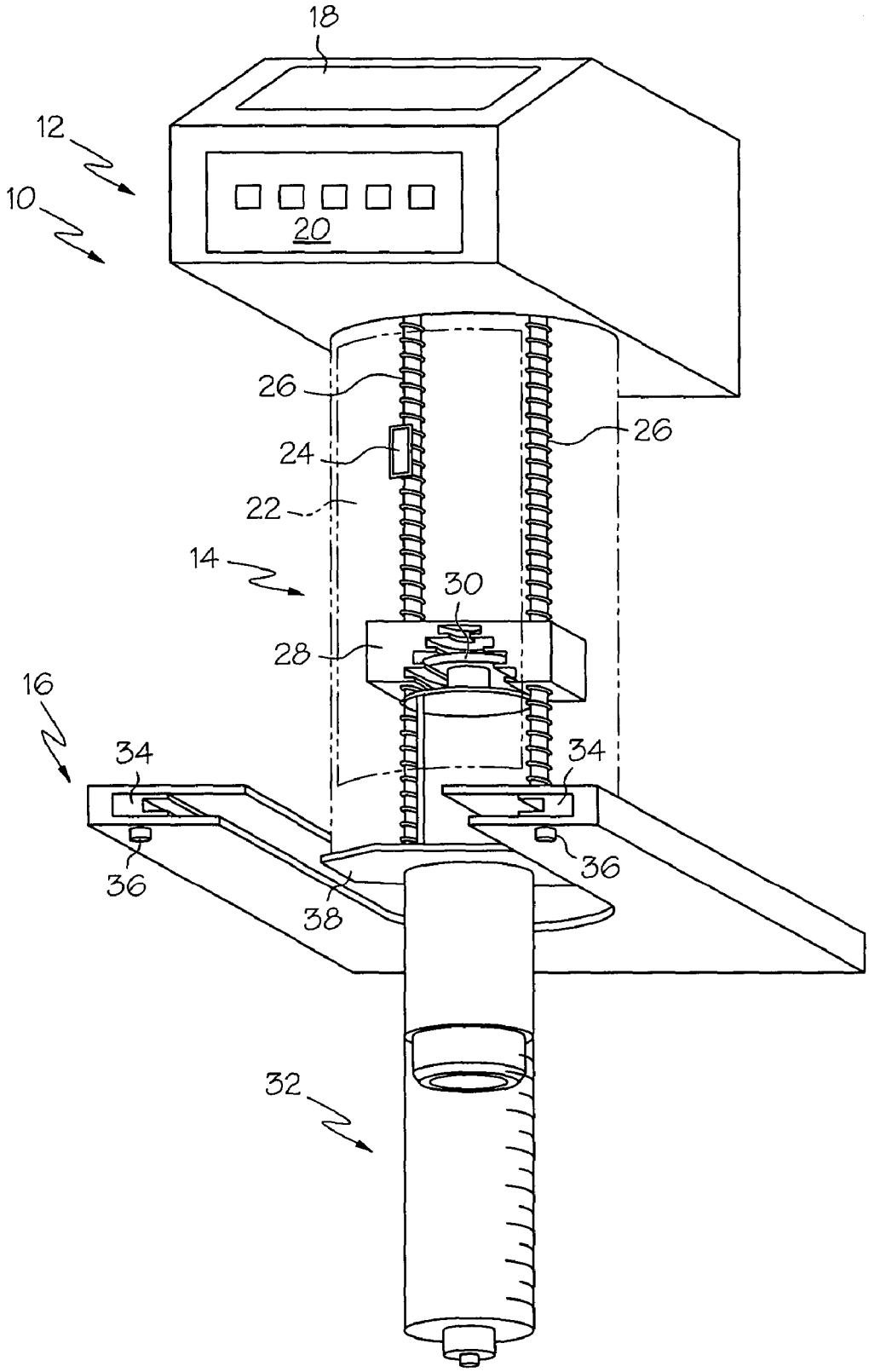
FIG. 1 is an perspective view of one embodiment of the syringe pump of the present invention having a disposable plastic syringe mounted within the pump.

Referring now to FIG. 1 of the drawings, the syringe pump 10 includes a head 12, a body 14 (shown in phantom) and a base 16. On the outer housing of the head 10 there is display 18, preferably in the form of an LCD display panel, and a keypad 20 having control buttons. On the outer housing of the body 14 there is a body cover 22 (in phantom) with a manual control switch 24. Inside the housing of the body 14 are drive shafts 26 and a drive block 28 which secures a plunger of a syringe 30. The base 16 of the syringe pump secures the barrel 32 of a syringe and includes barrel clamps 34 having adjustment knobs 36. Barrel clamps 34, which are shown in more detail in FIG. 4, fittingly secure the handle 38 of the syringe barrel 32.

Figure 2:
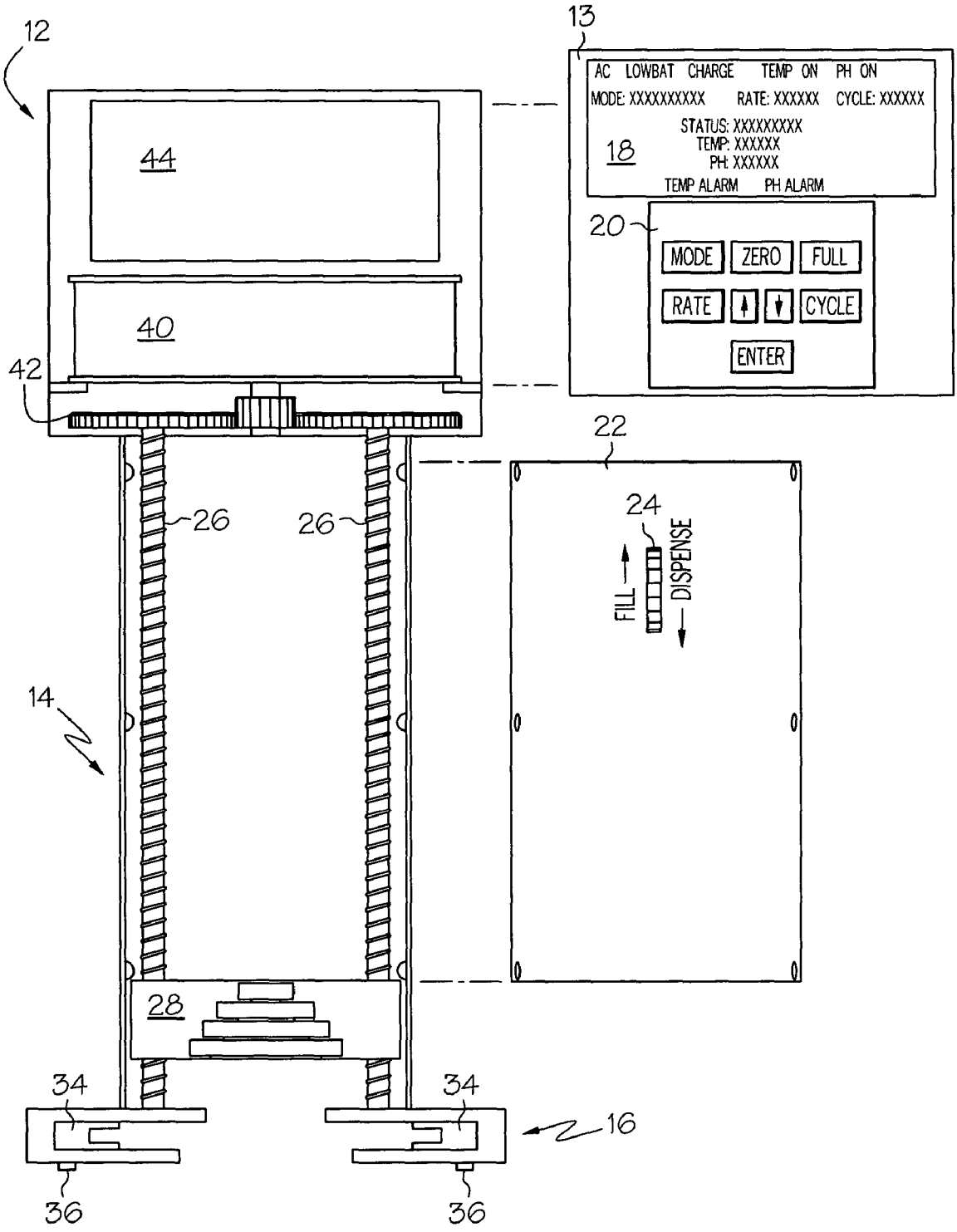
FIG. 2 is a frontal view of one embodiment of the syringe pump showing the inside of the head and body with the front covers thereof removed.
Figure 6:
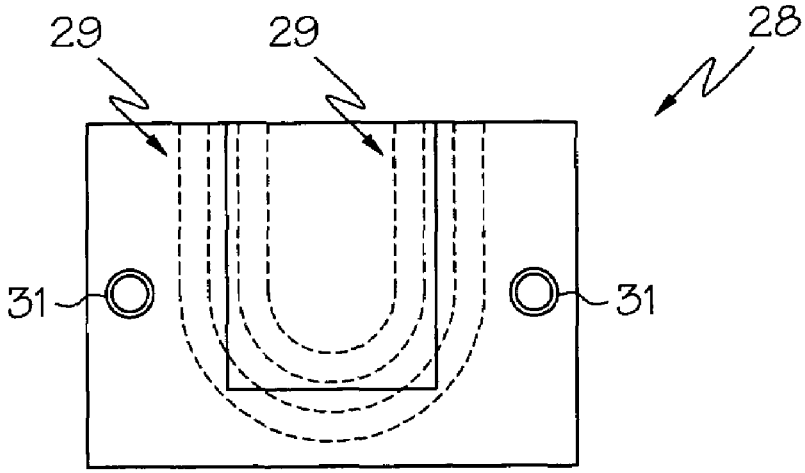
FIG. 6 is a bottom view of an isolated drive block from FIG. 1.

Looking now at FIG. 2, a frontal view of one embodiment of the syringe pump 10 depicts a stepping motor 40 mounted within the head 12 of the syringe pump which includes a gear assembly 42. A microcontroller 44, also known as a logic control circuit, and a rechargeable battery (behind the motor 40 and microcontroller 44, not shown) are also mounted within the head 12. The microcontroller 44 is best illustrated in FIG. 6 and will be explained in more detail below. Motor 40 is housed within a casing and is connected through gear assembly 42, which is part of the motor, to drive the drive shafts 26 located in the body 14. Each drive shaft 26 is externally screw-threaded and free to rotate in a journal bearing (not shown) located on the outer surface of the base 16. Drive shafts 26 driveably engage the drive block 28 which has holes (see FIG. 6) that are internally screw-threaded to match the external threading of the drive shafts. Drive from the motor 40 via the gear assembly 42 causes drive shafts 26 to rotate. Rotation of the drive shafts 26 causes drive block 28 to move, which, when the pump is in use, exerts pressure on the plunger 30 of a syringe 32 (see FIG. 1) mounted in the drive block 28.

As shown in FIG. 2, the drive shafts 26 and drive block 28 within the body 14 are covered by body cover 22. Body cover 22 includes a manual control switch 24 which can be moved by the user in either a fill direction or a dispense direction. Movement of control switch 24 will cause the drive block 28 to ascend or descend the drive shafts 26, thereby causing movement of a plunger loaded in the drive block 28 to move along the barrel of the syringe.

FIG. 2 also depicts a head cover 13 which fits over the head 12 and includes display 18 and keypad 20. The logic control circuit drives the display 18 which contains direct readouts for temperature and pH (TEMP, PH,). The display 18 also includes indicators for mode of operation, configuration settings, process status, and alarm conditions (i.e. TEMP ON, PH ON, MODE, RATE, CYCLE, STATUS, TEMP ALARM, PH ALARM). When the syringe pump 10 is in use, the temperature and pH are continuously monitored and displayed on display 18. Likewise, the AC indicator on the display illuminates when an AC adapter (not shown) is connected, the LOWBAT indicator illuminates when the battery voltage drops below a predetermined level, and the CHARGE indicator illuminates when the charging circuit is active.

There are control buttons on the keypad 20, as follows: MODE, ZERO, FULL, RATE, UP, DOWN, CYCLE and ENTER. The keypad is connected to the microcontroller 44 and inputs operating commands thereto. The MODE control button cycles the syringe pump through the pre-defined modes of operation: Manual, Auto, Program, and Serial. These modes will be displayed in the MODE indicator on the LCD display 18 and are described in more detail below.

Figure 3:
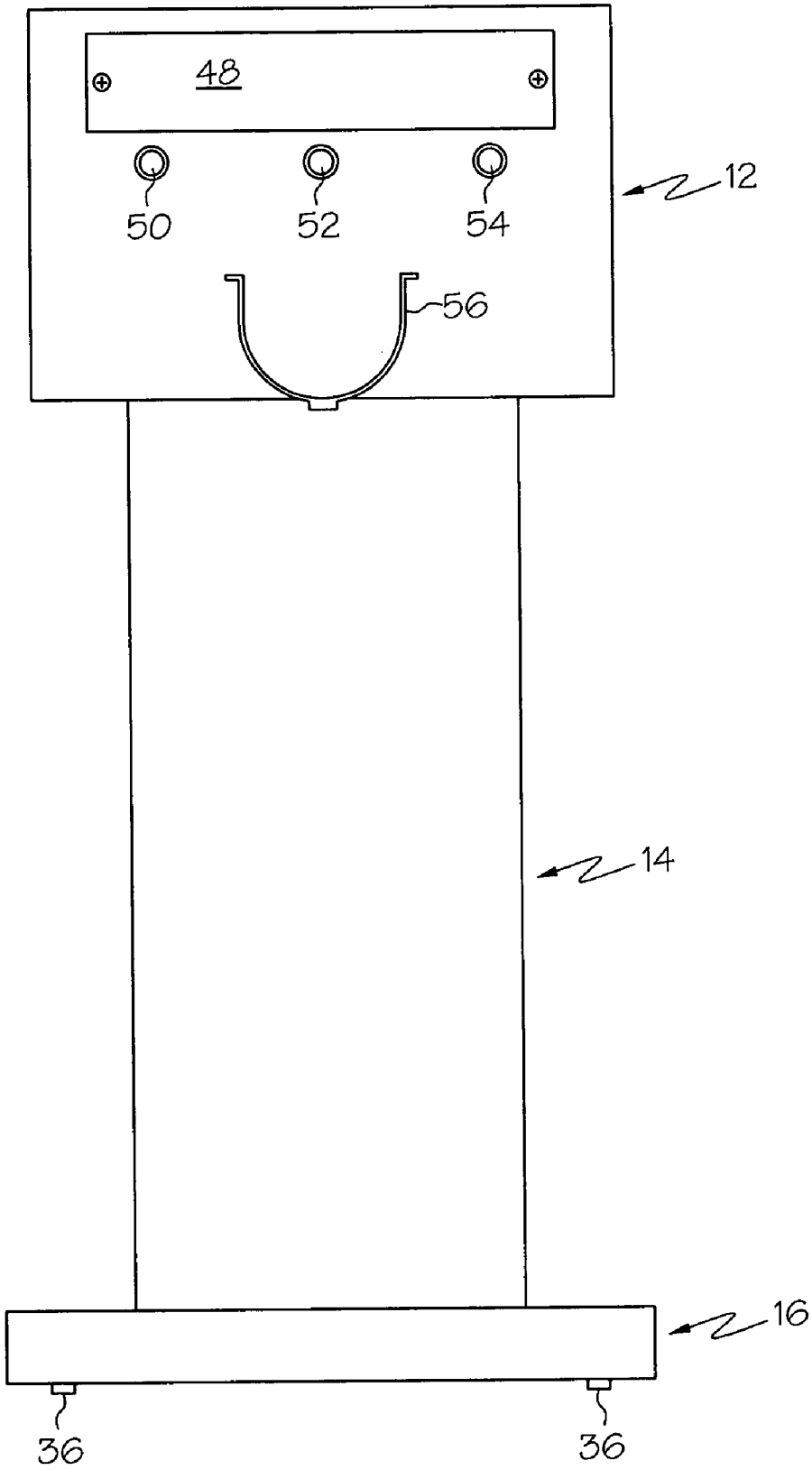
FIG. 3 is a rear view of the syringe pump depicted in FIG. 2.

The syringe pump of the present invention can be used to control addition of reagent over time. Changes to the dispensing rate of the pump can be programmed to occur according to physical properties of the reaction mixture. Plug-in probes measuring the physical properties of the reaction mixture relay information to the microcontroller via data input jacks. As shown in FIG. 3, located at the rear housing of the head 12 of the pump there is a battery cover 48, an AC adapter jack 50, and data input jacks 52 and 54 for receiving a plug-in probes. For example, jack 52 can receive a thermocouple/temperature probe, and jack 54 can receive a plug-in pH probe. In addition to temperature and pH, the pump can included jacks adapted receive probes which measure other ions in the reaction mixture, such as chloride, chlorate, perchlorate, fluoride, sodium, calcium, and iron. The pump may also have a jack for receiving a probe that measures the oxygen content of the reaction mixture. A recessed 'D' ring 56 is included for hanging the pump either within a laboratory hood during use, or for storage.

Figure 4:
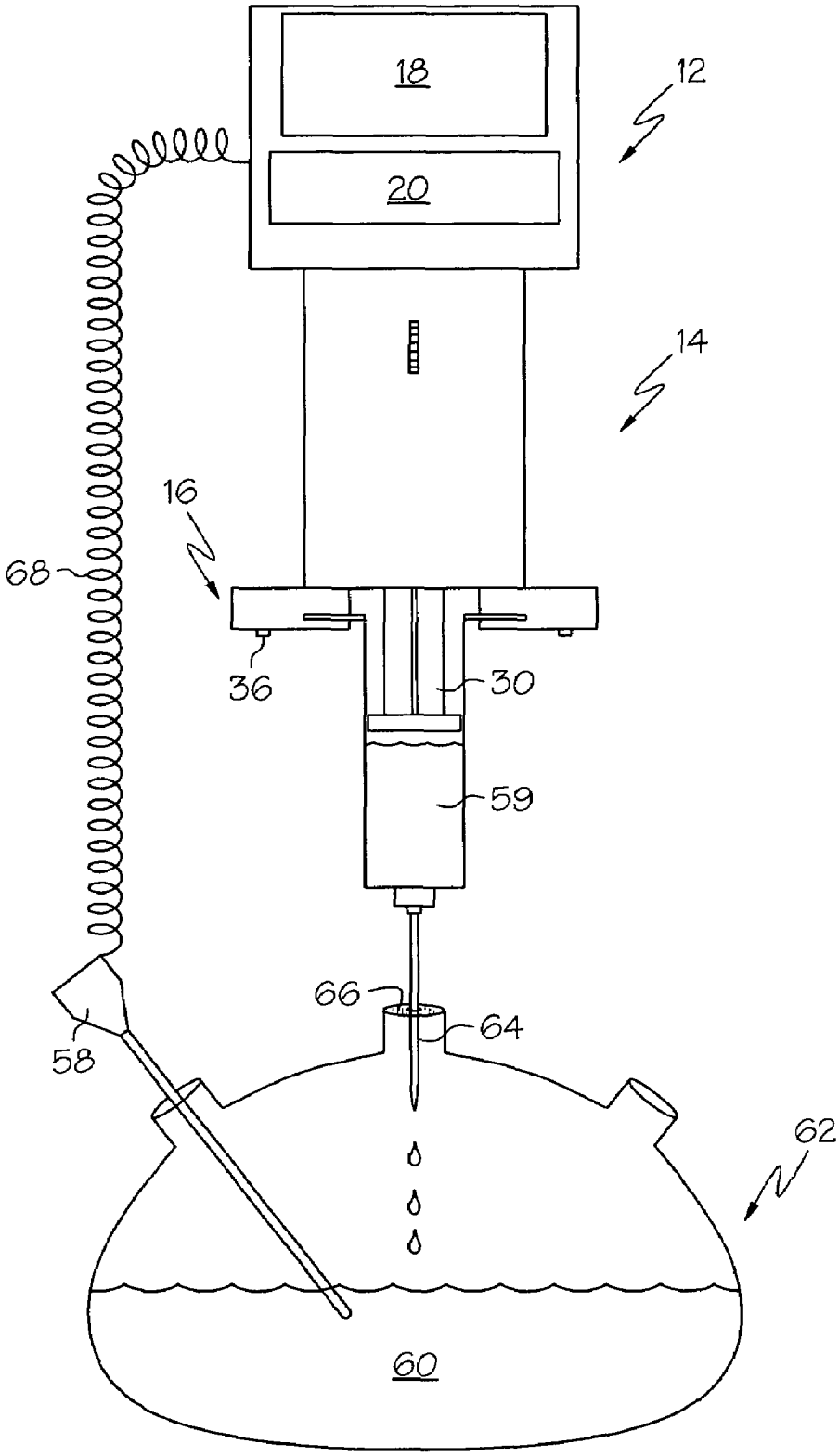
FIG. 4 is a perspective view of the syringe pump of the present invention in which a syringe is held within the pump and connected directly to a reaction mixture, with a probe leading from the reaction mixture to the pump.

FIG. 4 is a perspective view showing a syringe held within the pump. Probe 58 has one end sitting in the reaction mixture 60, which is contained in a container or laboratory flask 62. Reagent 59 is being pushed by the plunger 30 out of the syringe and into to reaction mixture 60, which sits inside flask 62. The syringe is connected to the flask 62 by a needle 64. Needle 64 pierces a septa 66 of the flask and provides direct access of the syringe contents to the reaction mixture 60. This is preferred for chemical reactions in which an inert atmosphere is essential.

The embodiment of the syringe pump shown in FIG. 4 combines the functions of a syringe pump and a temperature controller, such that probe 58, which, for example, can be a thermocouple temperature probe, is connected to the device to control delivery of reagent 59 to the reaction mixture 60 based on reaction mixture temperature. For example, thermocouple jack 52 (FIG. 3) can receive input from the thermocouple probe 58 which is in contact with the reaction mixture 60, and the pH jack 54 (FIG. 3) can receive input from a pH probe (not shown). The probes, in use, send input signals to the microcontroller via its corresponding probe jack 52, 54. The microcontroller can be programmed to receive input signals from the probes and to derive therefrom physical properties of the reaction mixture when the probes are in contact with the reaction mixture. The plug-in pH probe can work in a similar fashion as the temperature probe described immediately above, except it measures pH of the reaction mixture.

Figure 5:
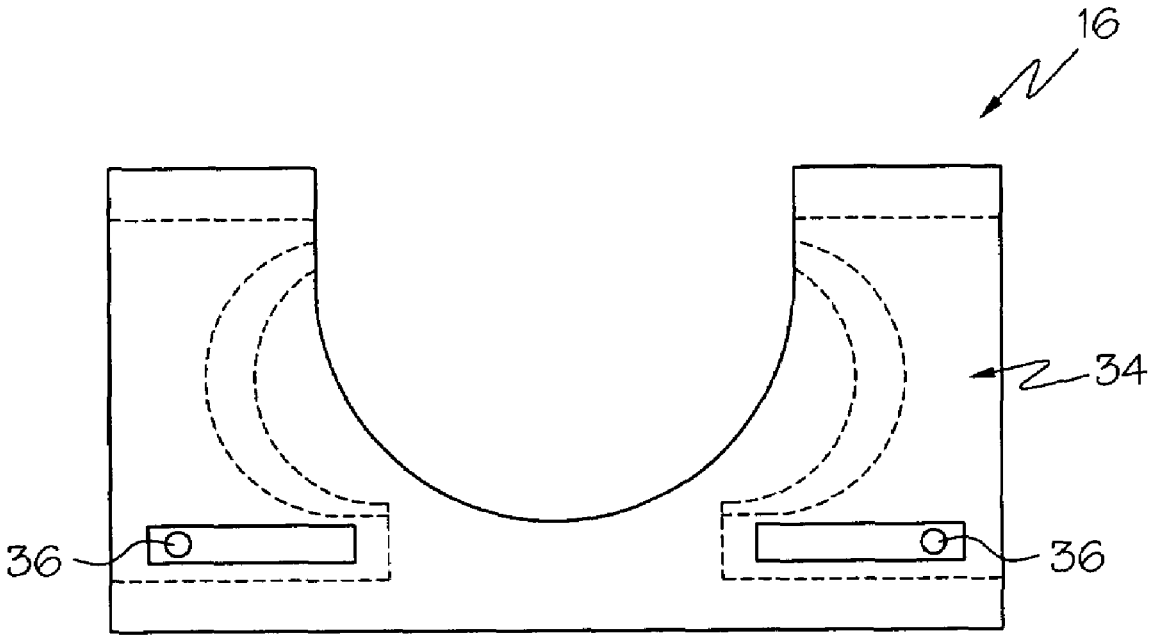
FIG. 5 is a bottom view of an isolated barrel clamp from FIG. 1.

FIG. 5 shows the base 16 of the syringe pump from beneath, and specifically depicts the barrel clamp 34 (in phantom) and the adjustment knobs 36 for the barrel clamp. Depending upon the size of the syringe, which can vary in their capacity from about 1 ml to about 50 ml volume, the adjustment knobs 36 are moved in or out to accommodate the barrel. Barrel clamp 34 has curved inner edges to accommodate commonly available disposable plastic syringes.

FIG. 6 is bottom view of the drive block 28 of FIG. 1. Drive block 28 includes hollow insertion rings 29 (shown in phantom) of graduated sizes which engage and hold the plunger of the syringe. The insertion rings can be seen within the drive block 28 from a frontal view in FIG. 2. Drive block 28 also includes internally screw-threaded holes 31 that match the external threading of the drive shafts 26. Using the drive block 28 of FIG. 6 and the barrel clamp 34 of FIG. 5, a disposable plastic syringe can be easily mounted on the pump as follows: the end rings of a plunger 30 (FIG. 1) fit into the hollow insertion ring 29 of its corresponding size within the drive block 28; the end wings 38 (FIG. 1) of the barrel of the syringe are then fitted within the barrel clamp 34 and held in position by adjusting the knobs 36 to accommodate the particular size of barrel.

In use, the motor 40 rotates the drive shafts 26 about their axis, which causes the drive block 28, which is driveably mounted on the external screw-thread of the drive shafts 26 via the internally screw-threaded holes 31 and capable of movement along the shafts 26, to descend the drive shafts 26, thereby moving the plunger 30 into the barrel of the syringe which expels reagent 59 from the loaded syringe over time. Once loaded into the syringe pump, the syringe can also be optionally connected to a check valve (not shown) for delivering multiple syringe volumes (i.e. in the range of 1 liter of total volume) to the reaction mixture over time.

Figure 7:
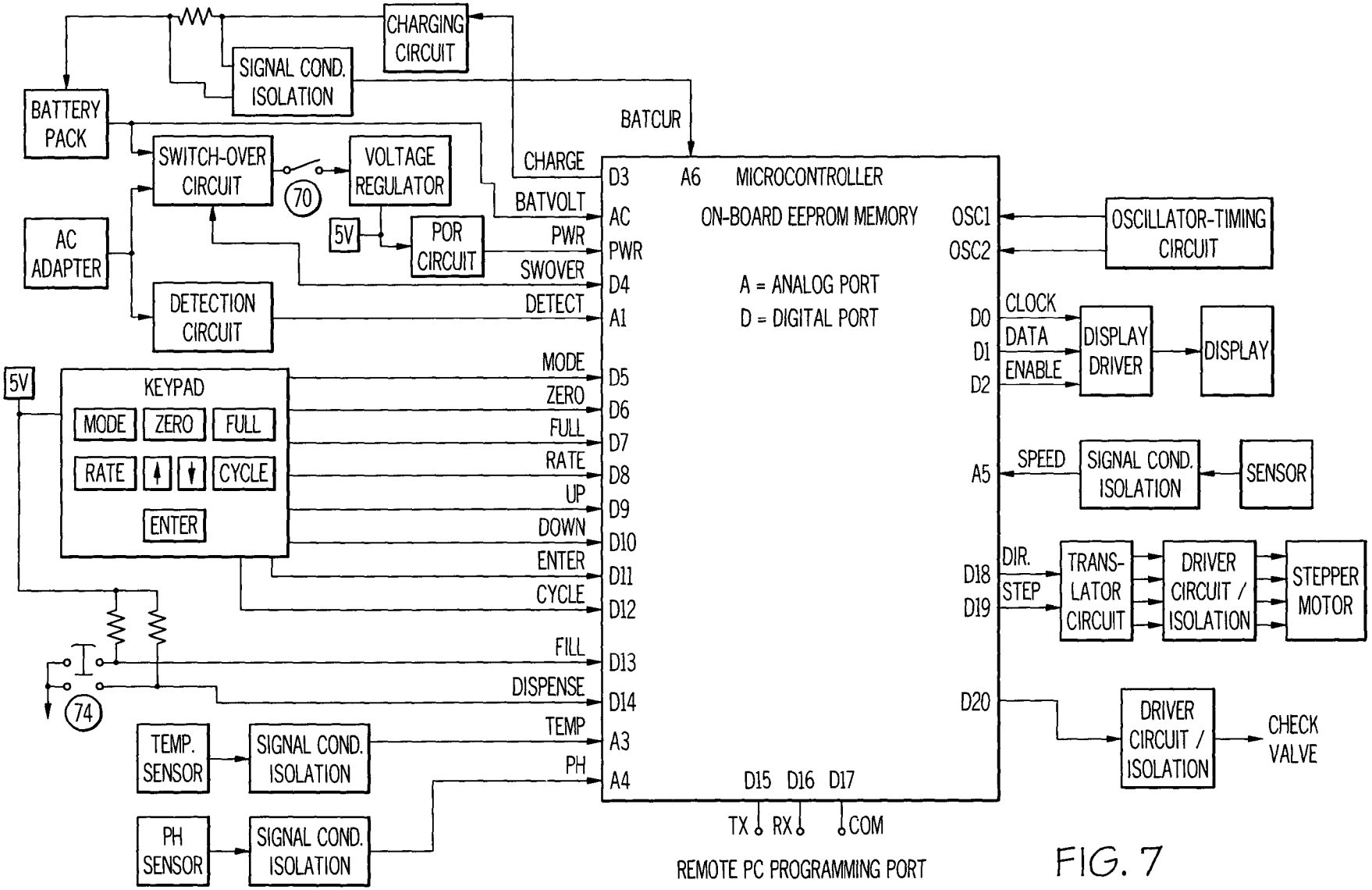
FIG. 7 is a generalized block diagram of one embodiment of the syringe pump.

FIG. 7 is a schematic drawing of the syringe pump depicting how the microcontroller, or logic control circuit, receives and gives input to and from the syringe pump. As shown in FIG. 7, power for the syringe pump is supplied by either a battery pack or an AC adapter. The AC adapter rectifies the line voltage and provides a DC input for the syringe pump. The magnitude of the DC input from the AC adapter would be chosen based on the voltage requirements of the stepper motor circuits. This in turn would be dependant on the amount of torque required by the process. In general, the magnitude of the DC voltage is between 5 and 12 VDC. The Detection Circuit senses the connection of the AC adapter. The Switch-over Circuit controls the power to the syringe pump based on the presence or absence of the AC adapter. Power Switch 70 controls power to the unit. An on-board Voltage Regulator provides a stable 5 VDC source for the Microcontroller. The power on reset (POR) circuit ensures proper start-up of the Microcontroller when power is applied.

When the AC adapter is connected to the system, the Charging Circuit charges the Battery Pack. Battery voltage and current are monitored for the charging process. Battery voltage is also monitored when the AC adapter is not connected to alert the user to a low battery condition. The Keypad, which includes the control buttons (MODE, ZERO, FULL, RATE, ↑ (up), ↓ (down), CYCLE and ENTER) connects to the Microcontroller and serves as the user interface for configuration and control of the syringe pump. The operation of the Keypad is discussed in detail below. The temperature and pH (and/or oxygen content or concentrations of ions such as chloride, chlorate, perchlorate, fluoride, sodium, calcium, and iron, if desired) of the reaction mixture are relayed to the Microcontroller via analog ports A3 and A4, respectively. The Microcontroller controls the speed of the stepping motor through digital ports D18 and D19 as dictated by the current rate setting and the input from the temperature and pH probes. The manual control switch 74 (which corresponds to the manual control switch 24 of FIG. 1) is a rocker switch used to manually extend and retract the syringe plunger regardless of the current settings and operation of the logic control circuit.

The microcontroller is a logic control circuit which responds to input commands from the control buttons on the keypad. Before use, the syringe pump can programmed by setting the volume of reagent to be delivered to the reaction mixture, the initial flow rate, and the maximum or minimum allowable temperature and/or ion concentration. After starting the pump, the device will deliver the desired volume at or below the desired temperature/pH limits. The microcontroller also processes the input signals generated by probes placed in the reaction mixture and can generate signals which activate changes in the delivery rate of the reagent according to its pre-set parameters. Further, if any predetermined parameters such as temperature or pH are violated, an alarm signal can be activated to alert the user.

Manual Mode

To operate the syringe pump in Manual mode, the user will press the MODE control button on the keypad 20 until the MODE section of the display 18 indicates "MANUAL". The current RATE setting will also be displayed on the display 18. The CYCLE field on the display 18 will be inactive.

The user then utilizes the manual control switch 24 to move the syringe plunger to the desired zero position, and then presses the ZERO control button on the keypad 20. Pressing the ZERO control button stores the reference position for the process. After the ZERO control button is pressed, the STATUS value on the display 18 will read "0.000". The user then operates the manual control switch 24 in the "fill" direction to retract the syringe plunger 30 to the desired fill position. The reagent to be added to the reaction mixture is drawn into the syringe during this step. As the plunger 30 moves toward the desired fill position, the STATUS value on the display area 18 lists the counts, length, or volume from the ZERO position. When the desired fill position is attained, the FULL control button is pressed to store the value for the process. The user can then hang the syringe pump on the 'D' ring 56 (FIG. 3) provided on the back panel thereof, or can secure the syringe pump via a clamp.

Next, the user presses the RATE control button on the keypad 20. The current rate is displayed as ml/min, ml/hour, cm/sec, etc. on the STATUS field of the display 18. The UP and DOWN control buttons are used to adjust the rate to the desired value. The ENTER control button is then pressed to store the new rate, and the updated rate is displayed in the RATE field of the display area 18.

When the manual control switch 24 is momentarily depressed in the dispense direction the dispensing process will proceed. The user can utilize the manual control switch to extend or retract the plunger if desired. The STATUS field displays the counts, length, or volume from the FULL reference position during movement of the plunger 30. Motor 40 will automatically stop at the programmed zero and full positions.

Auto Mode

To operate the syringe pump in Auto mode, the user presses the MODE control button on the keypad 20 until the MODE section of the display 18 indicates "AUTO". The CYCLE field on the display 18 will illuminate and provide the current cycle count setting. The user first programs the ZERO, FULL, and RATE settings as described above for the Manual Mode, and then presses the CYCLE control button on the keypad 20. The current cycle setting appears in the STATUS field of the display area 18. The user then uses the UP and DOWN control buttons to adjust the displayed STATUS field to the desired CYCLE count. The ENTER control button is then pressed to store the selected value. The CYCLE field on the display area 18 updates to the new value.

The user then initiates the cycling by momentarily pressing the manual control switch 24 in the DISPENSE direction. Motor 40 then repeats the DISPENSE, FILL, and DISPENSE process for the programmed number of cycles. For this mode, the syringe must be connected an intervening check valve. The check valve inlet is connected to a reagent source via a plastic tube and the check valve outlet is fitted with a needle or connected to the reaction vessel via a plastic tube. As the syringe pump executes fill and dispense strokes the reagent is transferred from the syringe to the reaction vessel. The STATUS field on the display again will indicate the position of the plunger 30 from the reference position. The CYCLE field on the display 18 decreases in increments during the dispensing process.

When the manual control switch 24 is momentarily depressed in the dispense direction the dispensing process will proceed. At any time, the dispensing process can be interrupted by operating the manual control switch 24 in either direction. If manually stopped, the dispensing process can be restarted by pressing the manual control switch 24 again.

Program Mode

The Program mode would be entered for configuration of the following dispensing process parameters: TMPON, TMPOFF TMPSTART, TMPSTOP, TMPALARM, pHON, pHOFF, pHCAL, pHSTART, pHSTOP pHALARM. To operate the syringe pump in Program mode, the user will press the MODE control button on the keypad 20 until the MODE section of the display 18 indicates "PROGRAM" and then press the ENTER control button on the keypad 20.

Upon entering the Program mode, the STATUS field on the display 18 indicates "TMP". Pressing the UP or DOWN control button on keypad 20 causes the STATUS field on display 18 to read "pH". The UP or DOWN control buttons on the keypad 20 are used to toggle between the TMP and pH programming modes. When the desired parameter ("TMP" or "pH") is displayed in the STATUS field of display 18, the ENTER control button is pressed.

TMP—When set to ON, the dispensing process can be stopped or started based on the temperature of the reaction mixture. When set to OFF temperature control is disabled. With the STATUS field on display 18 reading "TMP", depressing the ENTER control button on keypad 20 causes the STATUS field on display 18 to read "TMPOFF" Depressing the UP or DOWN control button on keypad 20 causes the STATUS field on display 18 to read "TMPON".

The UP or DOWN control buttons on the keypad 20 are used to toggle between "TMPOFF" and "TMPON". With the STATUS field of display 18 reading "TMPOFF" depressing the ENTER control button on keypad 20 causes the STATUS field on display 18 to read "TMP". The user can once again toggle between "TMP" and "pH" programming modes using the UP or DOWN control buttons on keypad 20. With the STATUS field of display 18 reading "TMPON" depressing the ENTER control button on key pad 20 causes the STATUS field on display 18 to alternately flash "TMPSTART" and a numerical value. Using the UP and DOWN control buttons on keypad 20 the user enters the maximum (or minimum) temperature at which the user desires syringe movement to start. Pressing the ENTER control button on keypad 20 stores the value and causes the STATUS field on display 18 to alternately flash "TMPSTOP" and a numerical value. Using the UP and DOWN control buttons on keypad 20 the user enters the maximum (or minimum) temperature at which the user desires syringe movement to stop. Pressing the ENTER control button on keypad 20 stores the value and causes the STATUS field on display 18 to alternately flash "TMPALARM" and a numerical value. Using the UP and DOWN control buttons on keypad 20 the user enters the maximum (or minimum) temperature at which the user desires an audible alarm to sound. Depressing the ENTER control button on keypad 20 stores the value and causes the STATUS field on display 18 to display "TMP". At this point the user can once again toggle between the "TMP" and "pH" programming modes using the UP and DOWN control buttons on the keypad 20. Depressing the MODE control button on the keypad 20 at this point exits the programming mode and causes the MODE section of 18 to display "AUTO".

When the manual switch 24 is momentarily depressed in the dispense direction the dispensing process will proceed. The dispensing process will stop when the temperature of the reaction mixture reaches the pre-set value of TMPSTOP. The dispensing process will be restarted when the temperature of the reaction mixture once again reaches the pre-set value of TMPSTART. The dispensing process will also be governed by the rate, pH or cycle control parameters programmed earlier.

pH—When set to ON, the dispensing process can be stopped or started based on the pH of the reaction mixture. When set to OFF pH control is disabled. With the STATUS field on display 18 reading "pH", depressing the ENTER control button on keypad 20 causes the STATUS field on display 18 to read "pHOFF" Depressing the UP or DOWN control button on keypad 20 causes the STATUS field on display 18 to read "pHON". The UP or DOWN control buttons on the keypad 20 are used to toggle between "pHOFF" and "pHON". With the STATUS field of display 18 reading "pHOFF" depressing the ENTER control button on keypad 20 causes the STATUS field of display 18 to read "pH". The user can once again toggle between "TMP" and "pH" programming modes using the UP or DOWN control buttons on keypad 20. With the STATUS field on display 18 reading "pHON" depressing the ENTER control button on keypad 20 causes the STATUS field on display 18 to alternately flash "pHSTART" and a numerical value. Using the UP and DOWN control buttons on keypad 20 the user enters the maximum (or minimum) pH at which the user desires syringe movement to start. Pressing the ENTER control button on keypad 20 stores the value and causes the STATUS field on display 18 to alternately flash "pHSTOP" and a numerical value. Using the UP and DOWN control buttons on keypad 20 the user enters the maximum (or minimum) pH at which the user desires syringe movement to stop. Pressing the ENTER control button on keypad 20 stores the value and causes the STATUS field on display 18 to alternately flash "pHALARM" and a numerical value. Using the UP and DOWN control buttons on keypad 20 the user enters the maximum (or minimum) pH at which the user desires an audible alarm to sound. Depressing the ENTER control button on keypad 20 stores the value and causes the STATUS field on display 18 to alternately flash "pHCAL1" and a numerical value. Using the UP and DOWN control buttons on keypad 20 the user enters a value for a pH calibration standard and immerses the attached pH electrode into a reference solution of the appropriate pH buffer. The user then depresses the ENTER control button on keypad 20. The STATUS field on display 18 now alternately flashes "pHCAL2" and a numeric value. Using the UP and DOWN control buttons on keypad 20 the user enters a value for a pH calibration standard and immerses the attached pH electrode into a reference solution of the appropriate pH buffer. The user then depresses the ENTER control button on keypad 20. The STATUS field on display 18 now reads "pH". At this point the user can once again toggle between the "TMP" and "pH" programming modes using the UP and DOWN control buttons on the keypad 20. Depressing the MODE control button on the keypad 20 at this point causes the MODE section of display 18 to read "AUTO".

When the manual switch 24 is momentarily depressed in the dispense direction the dispensing process will proceed. The dispensing process will stop when the temperature of the reaction mixture reaches the pre-set value of pHSTOP. The dispensing process will be restarted when the temperature of the reaction mixture once again reaches the pre-set value of pHSTART. The dispensing process will also be governed by any rate, temperature or cycle control parameters programmed earlier.

Serial Mode

The syringe pump of the present invention is also capable of operation in a Serial mode, wherein the syringe pump parameters are downloaded to the microcontroller of the syringe pump from a PC, or alternatively buffered data from the syringe pump microcontroller is down loaded to a PC, via a serial port. A separate PC application program would need to be developed to facilitate this function for the product, however this PC program is not part of the present invention.

The syringe pump of the present invention is able to transfer and deliver a single portion of liquid reagent of about 1 ml to about 50 ml volume (or approximately 1-5 liters in auto mode when equipped with a check valve) and over any desired time from about 1 to about 99 minutes. While the present invention has been illustrated by the description of embodiments thereof, and while the embodiments have been described in considerable detail, it is not intended to restrict or in any way limit the scope of the appended claims to such detail. Additional advantages and modifications will be readily apparent to those skilled in the art.

The invention in its broader aspects is therefore not limited to the specific details, representative apparatus and method, and illustrated examples shown and described.

Accordingly, departures may be made from such details without departing from the scope or spirit of Applicant's general inventive concept.

What is claimed is:

1. A syringe pump adapted to receive a syringe of the kind having a plunger movable along a barrel, the pump comprising:

a syringe driving mechanism including a motor, at least one drive shaft, a drive block, and a manual control switch;

a logic control circuit operable to control the syringe driving mechanism;

a barrel clamp adapted to secure the barrel of the syringe; and at least one data input jack adapted to receive a plug-in probe operable to measure a physical property of the reaction mixture, the at least one drive shaft being externally screw-threaded and connected at one end thereof to the motor so that, in use, the motor can rotate the at least one drive shaft about its axis, the drive block being driveably mounted on the at least one drive shaft in engagement with the external screw-thread thereof and operable to actuate the plunger of the syringe such that the plunger is moved along the barrel of the syringe at a predetermined rate, the at least one jack operable to relay input signals generated by the plug-in probe to the logic control circuit, the logic control circuit operable to process the input signals and adjust the rate according to the input signals, the manual control switch adapted to override the logic control circuit and allow manual actuation of the plunger, wherein the syringe pump can control the addition of a chemical reagent to a chemical reaction mixture.

2. A syringe pump as claimed in claim 1, further including a display system and a keypad having control buttons, the display system operable to display parameters relating to operating conditions of the syringe pump, the control buttons adapted to input operating commands to the logic control circuit.

3. A syringe pump as claimed in claim 1, wherein the input signals generated by the plug-in probe relate to physical properties of the reaction mixture, the physical properties selected from the group consisting of temperature, oxygen content, pH, chloride ion content, chlorate ion content, perchlorate ion content, fluoride ion content, sodium ion content, calcium ion content, and iron ion content.

4. A syringe pump as claimed in claim 3, wherein there are first and second data input jacks, the first data input jack adapted to receive a plug-in probe generating input signals relating to temperature, the second data input jack adapted to receive a plug-in probe generating input signals relating to pH.

5. A syringe pump adapted to receive a syringe of the kind having a plunger movable along a barrel, the pump comprising:

a head portion including a motor, a logic control circuit, a keypad having control buttons, and at least one data input jack, the control buttons adapted to input operating commands to the logic control circuit, the at least one jack adapted to receive a plug-in probe operable to measure a physical property of the reaction mixture, the at least one jack operable to relay input signals generated by the plug-in probe to the logic control circuit, the logic control circuit operable to process the input signals and the operating commands and to control the motor according to preset parameters;

a body portion including at least one drive shaft, a drive block, and a manual control switch, the at least one drive shaft being externally screw-threaded and connected at one end thereof to the motor so that, in use, the motor can rotate the at least one drive shaft about its axis, the drive block being driveably mounted on the at least one drive shaft in engagement with the external screw-thread thereof and operable to actuate the plunger of the syringe, the manual control switch adapted to allow the user to manually actuate the plunger; and a base portion including a barrel clamp adapted to secure the barrel of the syringe, wherein the syringe pump can be programmed by a user via the control buttons to control the addition of reagents to a chemical reaction mixture according to changes in the reaction mixture over time.

6. A syringe pump as claimed in claim 5, wherein the input signals relate to physical properties of the reaction mixture, the physical properties being selected from the group consisting of temperature, oxygen content, pH, chloride ion content, chlorate ion content, perchlorate ion content, fluoride ion content, sodium ion content, calcium ion content, and iron ion content.

7. A syringe pump as claimed in claim 5, wherein the head portion further includes a display system operable to visually display parameters relating to operating conditions of the syringe pump.

* * * * *